US008897683B2

(12) United States Patent
Chang et al.

(10) Patent No.: US 8,897,683 B2
(45) Date of Patent: Nov. 25, 2014

(54) FIXING SYSTEMS INCLUDING IMAGE CONDITIONER AND IMAGE PRE-HEATER AND METHODS OF FIXING MARKING MATERIAL TO SUBSTRATES

(75) Inventors: Shu Chang, Pittsford, NY (US); Dale R. Mashtare, Bloomfield, NY (US); Richard W. Seyfried, Williamson, NY (US); John F. Knapp, Fairport, NY (US); Grace T. Brewington, Fairport, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 643 days.

(21) Appl. No.: 12/855,078

(22) Filed: Aug. 12, 2010

(65) Prior Publication Data

US 2012/0039643 A1 Feb. 16, 2012

(51) Int. Cl.

*G03G 15/20* (2006.01)
*G03G 15/00* (2006.01)
*G03G 15/16* (2006.01)

(52) U.S. Cl.

CPC ..... *G03G 15/2021* (2013.01); *G03G 15/2007* (2013.01)
USPC ..... 399/320; 399/69; 399/122; 399/400

(58) Field of Classification Search

USPC ..... 399/69, 122, 320, 328, 339, 341, 342, 399/400

See application file for complete search history.

(56) References Cited

U.S. PATENT DOCUMENTS 5,608,512 A * 3/1997 Endo ..... 399/323
7,322,689 B2 1/2008 Kohne et al.
7,402,371 B2 7/2008 Sacripante et al.
7,407,278 B2 8/2008 Kohne et al.
7,494,757 B2 2/2009 Sacripante et al.
7,547,499 B2 6/2009 Veregin et al.
7,682,014 B2 3/2010 Snyder et al.
2006/0251451 A1* 11/2006 Ishigami et al. ..... 399/328
2007/0036594 A1* 2/2007 Mitsuoka et al. ..... 399/328
2009/0009573 A1 1/2009 Larson et al.
2009/0021550 A1 1/2009 Leighton et al.
2009/0102906 A1 4/2009 Phillips et al.
2010/0045720 A1 2/2010 Williams et al.

OTHER PUBLICATIONS

James Williams et al.; Temperature Leveling Roller and Pressure Nip Assembly; U.S. Appl. No. 12/617,255, filed Nov. 12, 2009.
John F. Knapp; "Apparatuses Useful in Printing and Methods of Fixing Marking Materials on Media"; U.S. Appl. No. 12/631,381, filed Dec. 4, 2009.

* cited by examiner

*Primary Examiner* — Joseph S Wong
(74) *Attorney, Agent, or Firm* — Ronald E. Prass, Jr.; Prass LLP

(57) ABSTRACT

Fixing systems, printing apparatuses and methods for fixing marking material to a substrate are provided. An exemplary embodiment of the fixing systems includes a pre-heating device for pre-heating a substrate and marking material disposed on a surface of the substrate; a fixing device disposed downstream from the pre-heating device, the fixing device including fixing members which oppose each other and form a fixing nip; and a first thermal energy source for heating at least one of the fixing members; wherein the fixing members apply pressure and thermal energy to the pre-heated substrate and marking material at the fixing nip to fix the toner to the substrate; and a conditioning device positioned (a) upstream from the pre-heating device, (b) between the pre-heating device and the fixing device, or (c) downstream from the fixing device. The conditioning device includes conditioning members which oppose each other and form a conditioning nip. The conditioning device does not include a thermal energy source that actively heats the conditioning members.

13 Claims, 7 Drawing Sheets

FIXING SYSTEMS INCLUDING IMAGE CONDITIONER AND IMAGE PRE-HEATER AND METHODS OF FIXING MARKING MATERIAL TO SUBSTRATES

RELATED APPLICATIONS

This application is related to U.S. patent application No. 12/855,011, entitled "MULTI-STAGE FIXING SYSTEMS, PRINTING APPARATUSES AND METHODS OF FIXING MARKING MATERIAL TO SUBSTRATES"; U.S. patent application No. 12/855,036, entitled "FIXING DEVICES FOR FIXING MARKING MATERIAL TO A WEB WITH CONTACT PRE-HEATING OF WEB AND MARKING MATERIAL AND METHODS OF FIXING MARKING MATERIAL TO A WEB"; U.S. patent application No. 12/855,054, entitled "FIXING DEVICES INCLUDING LOW-VISCOSITY RELEASE AGENT APPLICATOR SYSTEM AND METHODS OF FIXING MARKING MATERIAL TO SUBSTRATES"; U.S. patent application No. 12/855,066, entitled "FIXING SYSTEMS INCLUDING CONTACT PRE-HEATER AND METHODS FOR FIXING MARKING MATERIAL TO SUBSTRATES"; U.S. patent application No. 12/855,106, entitled "FIXING DEVICES INCLUDING EXTENDED-LIFE COMPONENTS AND METHODS OF FIXING MARKING MATERIAL TO SUBSTRATES"; and U.S. patent application No. 12/855,140, entitled "LOW ADHESION COATINGS FOR IMAGE FIXING", each of which is filed on the same date as the present application, commonly assigned to the assignee of the present application, and incorporated herein by reference in its entirety.

BACKGROUND

In some printing apparatuses, toner is applied to a substrate to form a toner image. The image can be heated while being subjected to pressure by a fixing device to fix the toner to the substrate. In these apparatuses, the fixing device can be subjected to temperature conditions that shorten the lifetime of components of the fixing device.

It would be desirable to provide fixing systems and methods for fixing marking material to a substrate that can utilize temperature conditions that allow lower run costs and desirable image quality.

SUMMARY

Fixing systems and methods for fixing marking material to a substrate are provided. An exemplary embodiment of the fixing systems comprises a a pre-heating device for pre-heating a substrate and marking material disposed on a surface of the substrate; a fixing device disposed downstream from the pre-heating device, the fixing device comprising fixing members which oppose each other and form a fixing nip; and a first thermal energy source for heating at least one of the fixing members; wherein the fixing members apply pressure and thermal energy to the pre-heated substrate and marking material at the fixing nip to fix the toner to the substrate; and a conditioning device positioned (a) upstream from the pre-heating device, (b) between the pre-heating device and the fixing device, or (c) downstream from the fixing device. The conditioning device comprises conditioning members which oppose each other and form a conditioning nip. The conditioning device does not include a thermal energy source that actively heats the conditioning members.

DRAWINGS

DETAILED DESCRIPTION

Figure 1:
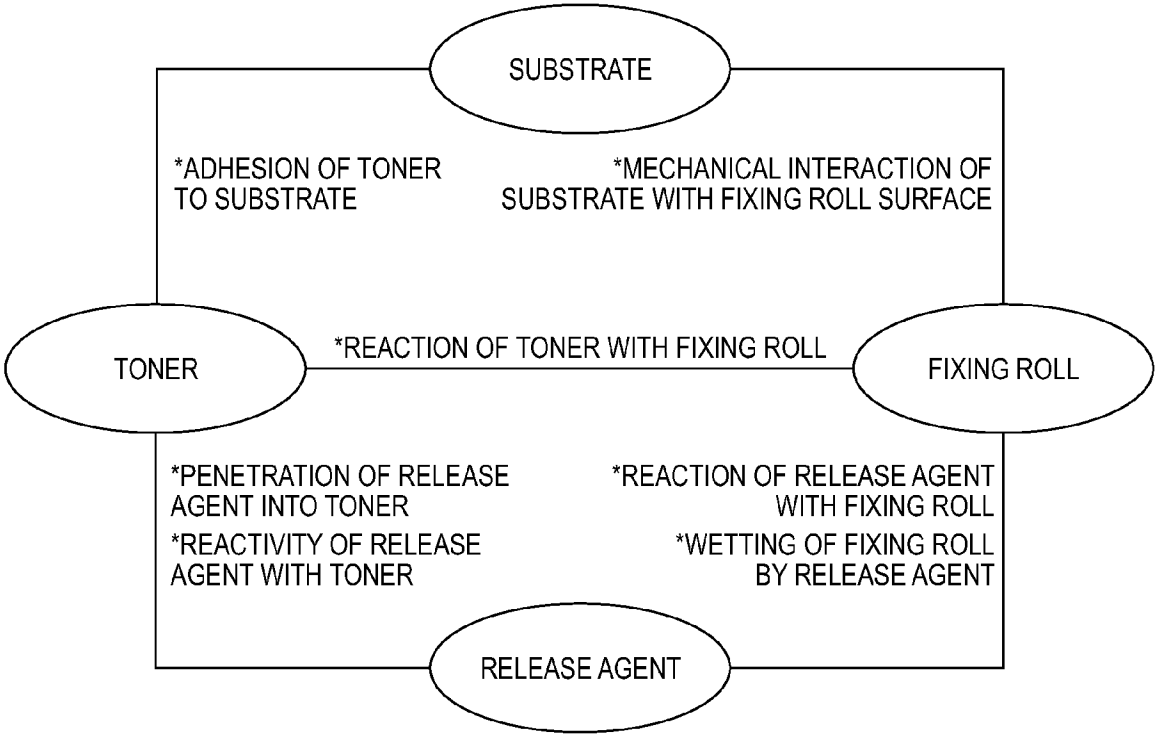
FIG. 1 illustrates mechanical and chemical interactions that may occur between components of a fixing device, toner and a release agent at a fixing nip.

The disclosed embodiments include fixing systems for fixing marking material to substrates. An exemplary embodiment of the fixing systems a pre-heating device for pre-heating a substrate and marking material disposed on a surface of the substrate; a fixing device disposed downstream from the pre-heating device, the fixing device comprising fixing members which oppose each other and form a fixing nip; and a first thermal energy source for heating at least one of the fixing members; wherein the fixing members apply pressure and thermal energy to the pre-heated substrate and marking material at the fixing nip to fix the toner to the substrate; and a conditioning device positioned (a) upstream from the pre-heating device, (b) between the pre-heating device and the fixing device, or (c) downstream from the fixing device. The conditioning device comprises conditioning members which oppose each other and form a conditioning nip. The conditioning device does not include a thermal energy source that actively heats the conditioning members.

Another exemplary embodiment of the fixing systems comprises a a pre-heating device for pre-heating a substrate and marking material disposed on a surface of the substrate; a fixing device disposed downstream from the pre-heating device comprising fixing members which oppose each other and form a fixing nip; and a first thermal energy source for heating at least one of the fixing members; wherein the fixing members apply pressure and thermal energy to the pre-heated substrate and marking material at the fixing nip to fix the toner to the substrate; and at least two of: a first conditioning device positioned upstream from the pre-heating device, the first conditioning fixing device comprising first conditioning members which oppose each other and form a first conditioning nip, wherein the first conditioning device does not include a thermal energy source that actively heats the first conditioning members which apply pressure to the substrate and marking material when received at the first conditioning nip; a second conditioning device positioned between the pre-heating device and the fixing device, the second conditioning device comprising second conditioning members which oppose each other and form a second conditioning nip, wherein the second conditioning device does not include a thermal energy source that actively heats the second conditioning members which apply pressure to the substrate and marking material when received at the second conditioning nip; and a third conditioning device positioned downstream from the fixing device, the third conditioning device comprising third conditioning members which oppose each other and form a third conditioning nip, wherein the third conditioning device does not include a thermal energy source that actively heats the third conditioning members which apply pressure to the substrate and marking material when received at the third conditioning nip.

The disclosed embodiments further include methods of fixing toner to a substrate. An exemplary embodiment of the methods comprises applying marking material comprising toner to a substrate with a marking device; pre-heating the substrate and marking material using a pre-heating device; feeding the pre-heated substrate and marking material to a fixing nip of a fixing device disposed downstream from the pre-heating device, the fixing nip being formed by opposed fixing members; applying heat and pressure to the pre-heated substrate and marking material at the fixing nip to fix the toner to the substrate; feeding the substrate and marking material to a conditioning nip of at least one conditioning device, each conditioning nip being formed by opposed conditioning members. The at least one conditioning device is positioned at one, two or all three of the following locations: (a) upstream from the pre-heating device, (b) between the pre-heating device and the fixing device, and (c) downstream from the fixing device. Each conditioning device does not include a thermal energy source that actively heats the opposed conditioning members. The method further comprises applying pressure to the substrate and marking material at the conditioning nip of the at least one conditioning device.

In some printing processes, images are formed on substrates using a marking material comprising dry toner. These printing processes may utilize a contact-type fixing device including opposed fixing members that form a fixing nip. In these fixing devices, an image on a substrate is fixed or fused by applying thermal energy and pressure to the substrate and image by contact with the fixing members at the fixing nip.

The fixing of toner onto a substrate can be achieved using high-temperature, low pressure conditions in contact fixing devices. These devices may utilize a roll or belt surface composed of an elastomeric material. In these devices, the elastomeric material may typically subjected to high surface temperatures of 150° C. to 210° C. and relatively-low fixing nip pressures of 60 psi to 100 psi. These fixing devices are operated at these high temperatures to be able to fix the toner material onto the substrate at the fixing nip in milliseconds of dwell time. At these temperature conditions, high-temperature-compatible elastomeric materials are required. A liquid release agent may be applied to the elastomeric surfaces in the fixing devices.

FIG. 1 depicts complex mechanical and chemical interactions that may occur between the substrate, toner, release agent and fixing roll in a contact fixing device during the fixing of toner onto a substrate at a fixing nip. These interactions affect the machine performance and service life. The use of high fixing temperatures and reactive chemicals creates a harsh mechanical and chemical operating environment for exposed elastomeric materials of the fixing members. Despite the use of high-temperature-compatible elastomeric materials, these harsh conditions in contact fixing devices commonly lead to the premature failure of the fixing members.

Another approach to fixing toner onto a substrate that has been used in printing includes non-contact fusing processes that heat the toner material by use of a radiant energy source with no pressure, or low pressure. These fusing processes rely upon radiant energy absorption and viscoelastic flow by the toner material resulting from irradiating the toner with radiant energy. It has been determined that this approach may produce limited image quality, introduces higher material costs due to additional property requirements placed upon the toner material, and also results in limited substrate compatibility.

As used herein, the term "printing apparatus" can encompass various types of apparatuses that are used to form images on substrates with marking materials. These apparatuses can include printers, copy machines, facsimile machines, multifunction machines, and the like.

In view of the above observations regarding the mechanical and chemical interactions that may occur in a contact fixing device that utilizes high fixing temperatures, fixing systems, printing apparatuses and methods of fixing marking material comprising toner to a substrate are provided. The fixing systems, printing apparatuses and methods can utilize a novel regime of applied pressures and temperatures for fixing toner to a substrate. The fixing systems, apparatuses and methods can produce a high image quality output while enabling use of robust, long-life subsystem components. The fixing systems, printing apparatuses and methods use a multi-step, toner fixing process. The fixing process includes pre-heating the toner material on a substrate to a temperature that may be relatively low. The pre-heated toner is subjected to pressure and heating conditions at a fixing nip that are effective to flow the pre-heated toner and provide adequate coalescence and adhesion of the toner to the substrate for desired uses of the prints. The fixing systems and printing apparatuses also include at least one conditioning device including conditioning members that are not actively heated, and which apply pressure to the marking material to condition the image.

By performing the toner fixing process as a multi-step process at lower temperatures, lower demands are placed on the heated fixing device components, enabling application of robust, long-life components. Embodiments of the fixing systems, printing apparatuses and methods can provide high image quality, a high level of printed image permanence, and reduced printing costs.

Figure 2:
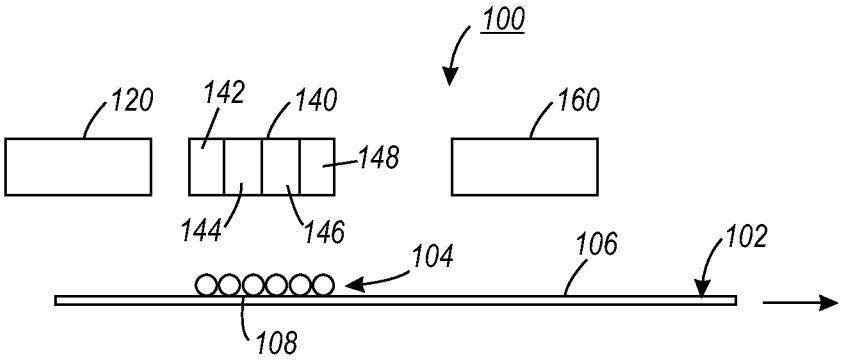
FIG. 2 depicts an exemplary embodiment of a printing apparatus.

FIG. 2 depicts an exemplary embodiment of a printing apparatus 100 for forming images on a substrate 102. The substrate 102 is in the form of a sheet. A continuous web substrate may alternatively be used in the printing apparatus 100. The substrate 102 can comprise coated or uncoated paper, or packaging material, for example. The printing apparatus 100 includes a substrate feeding device 120, a marking device 140, and a fixing system 160. A substrate 102 is fed by the substrate feeding device 120 to the marking device 140 to apply marking material 104 to a front surface 106 of the substrate 102. The marking material 104 comprises toner. The substrate 102 is advanced to the fixing system 160 to fix the toner to the front surface 106.

The marking device 140 can have any suitable configuration for applying marking material comprising toner to the substrate 102. In embodiments, the toner material comprises dry toner particles. The toner material may contain one or more additives. In the marking device 140, carrier particles may be used to assist in delivery of toner material. The marking device 140 can be constructed to apply marking material directly to the substrate 102 to form toner images. In other embodiments, the marking device 140 can be constructed to apply marking material to an intermediate member, such as a roll or belt, and then to transfer the marking material from the intermediate member to the substrate 102.

The depicted marking device 140 includes marking stations 142, 144, 146 and 148 arranged in series along the process direction of the substrate 102. The marking stations 142, 144, 146 and 148 can each apply a different colored toner material, such as black, cyan, magenta and yellow toner material, respectively, to the front surface 106 of the substrate 102 to form a color image. The marking device 140 can also be used to produce monochromatic images. While the marking device 140 is shown as applying marking material 104 (depicted as particles) only to the front surface 106 of the substrate 102, other embodiments of the printing apparatus 100 can be configured to produce duplex prints.

The fixing system 160 is provided in the printing apparatus 100 to fix the marking material to the front surface 106 of the substrate 102. Exemplary embodiments of the fixing system 160 are depicted in FIGS. 3 to 6.

Figure 3:
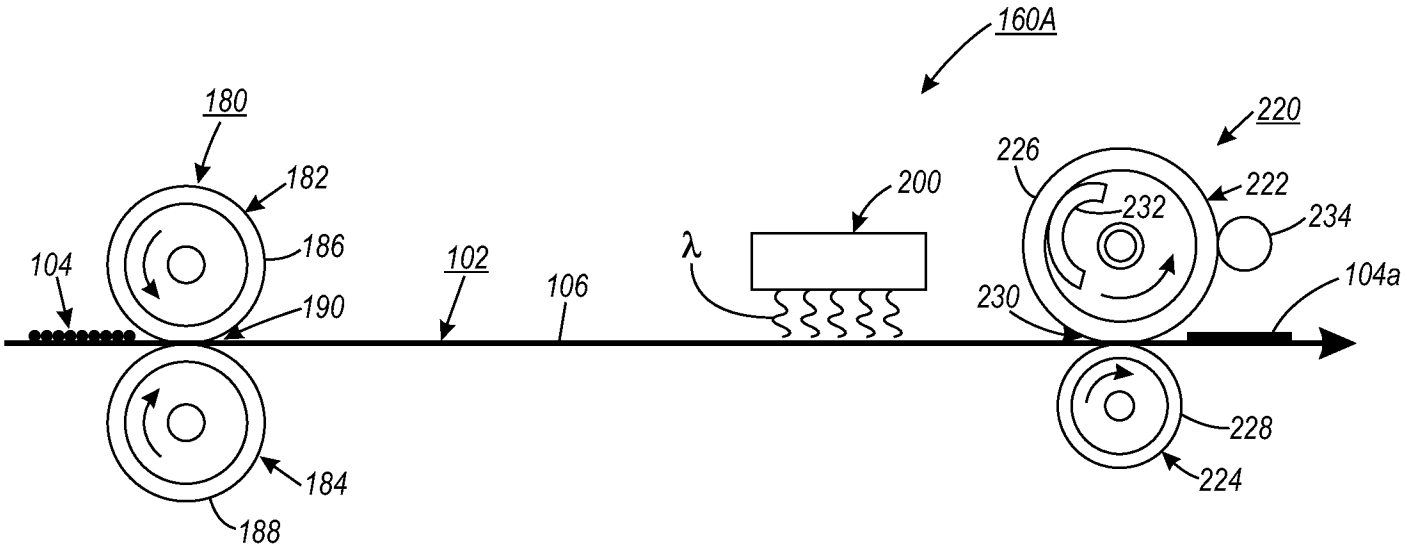
FIG. 3 depicts an exemplary embodiment of a fixing system.

FIG. 3 depicts a fixing system 160A including a conditioning device 180, a pre-heating device 200 and a fixing device 220 arranged in this order along the process direction. The conditioning device 180 includes conditioning members that apply pressure to the marking material 104 and substrate 102. In the illustrated embodiment, the conditioning members include a first roll 182 and a second roll 184. The first roll 182 includes a first outer surface 186 and the second roll 184 includes a second outer surface 188. The first outer surface 186 and second outer surface 188 define a conditioning nip 190 at which the substrate 102 is received.

The substrate 102 and marking material 104 may, or may not, be actively heated before arriving at the conditioning device 180. In the conditioning device 180, the first roll 182 and second roll 184 are not actively heated. The conditioning device 180 does not include any surface that contacts and actively heats the substrate 102 and marking material 104 at the conditioning nip 190. The conditioning device 180 can be referred to as a "non-thermal" conditioning device. The first roll 182 and second roll 184 apply pressure to the substrate 102 and marking material 104 at the conditioning nip 190. The first outer surface 186 and the second outer surface 188 of the first roll 182 and second roll 184, respectively, comprise a hard material, such as a metal (e.g., steel, stainless steel, or anodized aluminum) or a ceramic material. Anodized aluminum or ceramic material coatings may be impregnated with materials, such as polytetrafluoroethylene (Teflon®)), for release properties. The first roll 182 and the second roll 184 can typically apply a pressure of about 100 psi to about 5000 psi at the conditioning nip 190.

The pre-heating device 200 includes at least one thermal energy source for pre-heating the substrate 102 and marking material 104 after passing through the conditioning nip 190. In the illustrated embodiment, the pre-heating device 200 includes one or more radiant heaters, such as lamps, that emit radiant energy to heat the substrate 102 and marking material 104. In other embodiments, the pre-heating device 200 can be constructed to heat the substrate 102 and marking material 104 by conduction. For example, the pre-heating device 200 can include opposed rolls (at least one of which is internally and/or externally heated) forming a nip at which thermal energy and pressure are applied to the substrate 102 and marking material 104. Other embodiments of the pre-heating device 200 can heat the substrate 102 and marking material 104 by convection, such as by steam heating, or the like.

In the fixing system 160A, the substrate 102 and marking material 104, may, or may not, be actively heated prior to arriving at the conditioning device 180. When the substrate 102 and marking material 104 are not actively heated before arriving at the conditioning device 180, the substrate and marking material may reach the pre-heating device 200 at about ambient temperature, $T_{amb}$. In the printing apparatus 100, the ambient temperature $T_{amb}$ is the temperature of the cavity of the printing apparatus 100 that the substrate 102 and marking material 104 are exposed to. At the pre-heating device 200, the temperature, $T_{int}$, at the interface between the front surface 106 of the substrate 102 and marking material 104 may be increased from about ambient temperature to less than the melting temperature, $T_m$ of the toner, i.e., $T_{amb}<T_{int}<T_m$. For example, $T_{int}$ may reach about 30° C. to about 110° C., such as about 50° C. to about 100° C., or about 60° C. to about 90° C., during heating at the pre-heating device 200. Depending on the toner composition, $T_{int}$ may not exceed the glass transition temperature, $T_g$, of the toner. The toner may be partially fused by this pre-heating. When a maximum value of $T_{int}$ of less than 100° C. is reached at the pre-heating device 200, problems caused by the vaporization of water contained in print media, which include damage to the media (blistering) and/or damage to the images (e.g., blow-off or icicles), can be avoided in the printing apparatus 100.

The fixing device 220 is constructed to actively heat the substrate 102 and marking material 104 and can be referred to as a "thermal," contact fixing device. Pre-heating the substrate 102 and toner using the pre-heating device 200 allows the fixing device 220 to be operated at lower fixing temperatures as compared to a fixing device that is required to heat toner from ambient temperature to the fixing temperature at its fixing nip within a short dwell time.

In the fixing system 160A, the conditioning device 180 acts as a toner pre-conditioner to compact and spread the agglomerated toner particle structure of the image on the substrate 102 before the image reaches the pre-heating device 200 and the fixing device 220. The toner image prior to fusing is typically comprised of disconnected toner agglomerates having a thickness of several monolayers. The conditioning device 180 is provided upstream from the fixing device 220 to restructure the image layer on the substrate 102 to produce more uniform toner spreading, and a thinner and more close-packed image layer. Toner piles that are more compact and more uniformly spread enable better heat transfer in the image layer, more uniform image appearance, and need reduced dwell time to achieve image coalescence. Additionally, the toner fix produced by pre-conditioning using the conditioning device 180 allows handling of the toner image and substrate without disturbance to the image fidelity.

In the fixing system 160A, the fixing device 220 applies additional energy to the pre-heated substrate 102 and marking material 104 to cause the toner particles to coalesce (cohere) and also provide adequate adhesion of the image to the substrate 102. The pre-conditioning of the image layer by the conditioning device 180 allows the use of a lower pre-heating temperature at the pre-heating device 200 and/or a lower fixing temperature at the fixing device 220. The fixing device 220 includes a third roll 222 and a fourth roll 224. The third roll 222 includes a third outer surface 226 and the fourth roll 224 includes a fourth outer surface 228 forming a fixing nip 230. At the fixing nip 230, the substrate 102 and marking material 104 are contacted by the third roll 222 and fourth roll 224 and subjected to additional heating and applied pressure. FIG. 3 shows the marking material 104*a* having a more flattened shape and being coalesced as a result of passing through the fixing nip 230.

The third roll 222 is internally heated by a thermal energy source 232, which heats the outer surface 226 to the desired fixing temperature. The total amount of energy supplied to the substrate 102 and marking material 104 at the fixing nip 230, which includes thermal energy conducted from the first roll 222, and energy from the application of pressure, is sufficient to allow the fixing device 220 to achieve adequate toner adhesion and cohesion while being operated at relatively-low temperature and moderate pressure conditions, as well as to operate at a lower dwell.

The third roll 222 and fourth roll 224 produce the desired amount of pressure at the fixing nip 230. Typically, the pressure at the fixing nip 230 can be from about 300 psi to about 1500 psi.

In embodiments, the third roll 222 can include a metallic or ceramic substrate having a surface region impregnated with a material to provide release characteristics. For example, the third roll 222 can comprise an aluminum substrate that has been subjected to an anodizing treatment to convert the surface region of the substrate, including the third outer surface 226, to porous anodized aluminum (aluminum oxide, $Al_2O_3$). The pores of the anodized surface region can be impregnated with a substance having desirable release properties, such as Teflon®, Teflon® PFA, or the like, to seal the pores. The resulting third outer surface 226 provides desirable hardness and release properties.

The fourth roll 224 can comprise a core and a deformable polymeric material overlying the core and forming the outer surface 228. For example, the polymeric material can be polyurethane, nitrile butadiene rubber, or the like. The polymeric material can be applied as a single layer, or as two or more layers.

In other embodiments of the fixing device 220, the fourth roll 224 optionally can also be internally and/or externally heated to heat the fourth outer surface 228.

The fixing device 220 is operable to heat the substrate 102 and marking material 104 to achieve a temperature, $T_{int}$, at the interface between the substrate 102 and marking material 104 that is sufficient to achieve adequate coherence and adhesion of the toner. Some amount of cooling of the substrate 102 and marking material 104 as the substrate advances between the pre-heating device 200 and the fixing nip 230. Depending on the process speed in the printing apparatus 100 and the distance between the pre-heating device 200 and the fixing nip 230 along the process direction, the substrate 102 can typically reach the inlet of the fixing nip 230 within about 50 ms to about 1000 ms after passing the pre-heating device 200.

When the substrate 102 and marking material 104 enter the fixing nip 230, $T_{int}$ is above $T_{amb}$ and is increased to at least $T_m$, of the toner. At the fixing nip 230, $T_{int}$ can reach, e.g., about 50° C. to about 120° C., such as about 70° C. to about 100° C., or about 70° C. to about 90° C., for fixing the toner on the substrate 102. The temperature set point for the outer surface 226 of the third roll 222 can be, e.g., about be about 50° C. to about 120° C., such as about 70° C. to about 110° C., or about 80° C. to about 100° C. to heat the toner to the desired temperature. When operating at a maximum temperature set point of less than 100° C. at the fixing nip 230, the vaporization of water contained in print media can be avoided.

The use of lower temperatures at the fixing nip 230 can reduce wear of the fixing device 220 and provide a longer life of the second fixing device 220.

In embodiments, the fixing device 220 includes a release agent applicator 234 for applying a release agent to the first outer surface 226 of the third roll 222 to reduce image offset and also assist in stripping of the substrate from the third roll 222 following fixing. In the fixing device 220, the use of lower fixing temperatures at the fixing nip 230 allows the use of release agents having a lower viscosity (and vapor pressure) than release agents that are suitable for use at higher fixing temperatures.

Accordingly, in embodiments of the fixing systems, such as the fixing system 160A, non-thermal, toner pre-conditioning can be used to compact and spread toner layers to promote more efficient heating by a pre-heating device with or without applied pressure and by a thermal fixing device with a heated pressure nip. The toner pre-conditioning can provide a temporary fix of the toner layer, which is sufficient to enable handling of the un-fused image for pre-heat and paper handling requirements.

Figure 4:
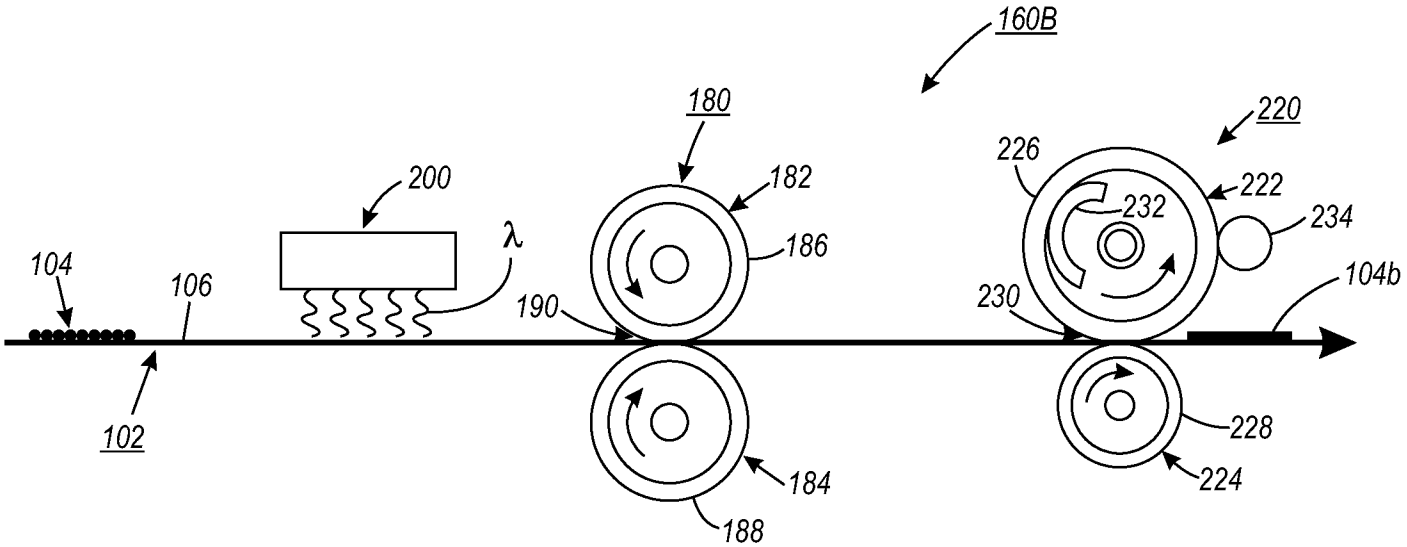
FIG. 4 depicts another exemplary embodiment of a fixing system.

FIG. 4 depicts a fixing system 160B according to another exemplary embodiment. As shown, the fixing system 160B includes a pre-heating device 200, a conditioning device 180, and a fixing device 220 arranged in this order along the process direction. In this embodiment, the pre-heating device 200, conditioning device 180 and fixing device 220 may have the same or similar construction, or a different construction, as the pre-heating device 200, conditioning device 180, and fixing device 220, respectively, of the fixing system 160A shown in FIG. 3, as described herein.

In the fixing system 1608, the substrate 102 and marking material 104, may, or may not, be actively heated prior to arriving at the pre-heating device 200. When the substrate 102 and marking material 104 are not actively heated, the substrate 102 and marking material 104 may reach the pre-heating device 200 at about ambient temperature, $T_{amb}$. In the printing apparatus 100, the ambient temperature $T_{amb}$ is the temperature of the cavity of the printing apparatus 100 that the substrate 102 and marking material 104 are exposed to. At the pre-heating device 200, the temperature, $T_{int}$, at the interface between the substrate 102 and marking material 104 may be increased from about ambient temperature to less than the melting temperature, $T_m$, of the toner, i.e., $T_{amb}<T_{int}<T_m$. For example, $T_{int}$ may reach about 30° C. to about 110° C., such as about 50° C. to about 100° C., or about 60° C. to about 90° C., during heating at the pre-heating device 200. Depending on the toner composition, $T_{int}$ may not exceed the glass transition temperature, $T_g$, of the toner. The toner may be partially fused by this heating.

As the pre-heating device 200 pre-heats and softens the toner, which reduces the modulus of the toner, before the toner reaches the conditioning device 180, the amount of pressure applied to the marking material at the conditioning nip 190 of the conditioning device 180 that is sufficient to achieve the desired effects can be significantly lower than applied at the conditioning nip 190 of the fixing system 160A, which does not include a pre-heating device upstream of the conditioning device 180 to pre-heat the marking material. For example, the amount of pressure applied at the conditioning nip 190 can be from about 100 psi to about 5000 psi.

The pre-heating device 200 and the conditioning device 180 together produce a partially-melted and uniformly spread toner layer entering the fixing nip 230 of the fixing device 220. As a result, lower pressure and temperature conditions can be used at the fixing nip 230, which can result in better image gloss appearance. For example, at the fixing nip 230, the pressure can be from about 300 psi to about 1500 psi, and $T_{int}$ may reach, e.g., about 50° C. to about 120° C., such as about 70° C. to about 110° C., about 80° C. to about 110° C., or about 80° C. to about 100° C., for fixing the toner on the substrate 102. The temperature set point for the outer surface 226 of the third roll 222 can be about be about 50° C. to about 120° C. to achieve the desired toner temperature.

Accordingly, in embodiments of the fixing systems, such as the fixing system 160B, the use of a non-thermal conditioning device to provide intermediate toner conditioning can enhance toner spread and toner layer coalescence readily with the softened toner layers as a result of the preheat. The toner conditioning provides improved spread and coalescence of the toner.

Figure 5:
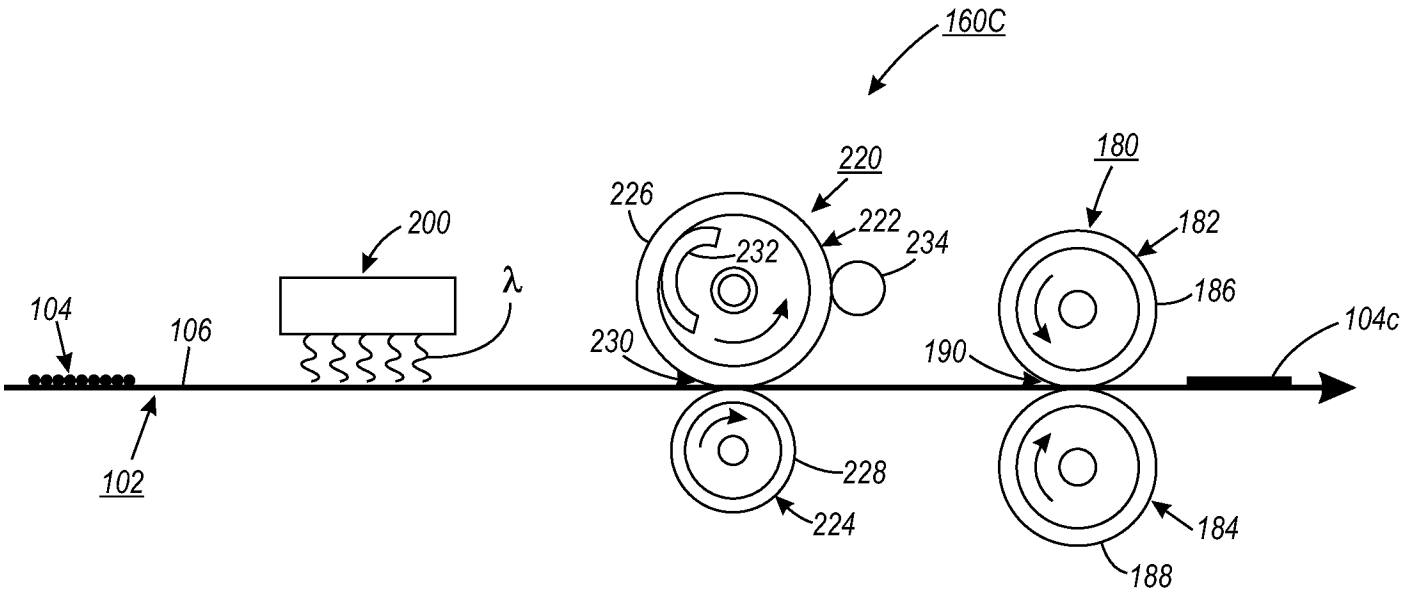
FIG. 5 depicts another exemplary embodiment of a fixing system.

FIG. 5 depicts a fixing system 160C according to another exemplary embodiment. As shown, the fixing system 160C includes a pre-heating device 200, a fixing device 220, and conditioning device 180 arranged in this order along the process direction. In this embodiment, the pre-heating device 200, fixing device 220, and conditioning device 180 may have the same or a similar construction, or a different construction, as the pre-heating device 200, fixing device 220 and conditioning device 180, respectively, of the fixing systems 160A and 160B shown in FIGS. 3 and 4, as described herein.

In the fixing system 160C, the pre-heating device 200 and fixing device 220 apply thermal energy and pressure to the marking material on the substrate 102 to produce images. At the pre-heating device 200, the temperature, $T_{int}$, at the interface between the substrate 102 and marking material 104 is increased. The substrate 102 and marking material 104 may, or may not, be actively heated before arriving at the pre-heating device 200. When the substrate 102 and marking material 104 are not actively heated, the substrate 102 and marking material 104 may be at about ambient temperature when arriving at the pre-heating device 200. In the printing apparatus 100, the ambient temperature $T_{amb}$ is the temperature of the cavity of the printing apparatus 100 that the substrate 102 and marking material 104 are exposed to. At the pre-heating device 200, $T_{int}$ may be increased from about ambient temperature to less than the melting temperature, $T_m$ of the toner, i.e., $T_{amb}<T_{int}<T_m$. For example, $T_{int}$ may reach about 30° C. to about 100° C. at the pre-heating device 200. Depending on the toner composition, $T_{int}$ may not exceed the glass transition temperature, $T_g$, of the toner. The toner may be partially fused by this pre-heating.

At the fixing nip 230, the pressure can be from about 300 psi to about 1500 psi, and $T_{int}$ can reach, e.g., about 50° C. to about 120° C., such as about 70° C. to about 110° C., about 80° C. to about 110° C., or about 80° C. to about 100° C., for fixing the toner on the substrate 102. The temperature set point for the outer surface 226 of the third roll 222 can be, e.g., about be about 50° C. to about 120° C. to heat the toner to the desired temperature.

In the fixing system 160C, the conditioning device 180 functions as a glossing device for toner images produced by the pre-heating device 200 and fixing device 220, which use lower temperatures and moderate applied pressure. In the fixing system 160C, the conditioning device 180 provides additional smoothing to improve the image gloss uniformity, and/or alter the average gloss level. The outer surface 186 of the first roll 182 and the outer surface 188 of the second roll 184 may have a surface finish selected to impart gloss finish variation to the final image. At the conditioning nip 190, the pressure can typically be from about 100 psi to about 5000 psi.

Figure 6:
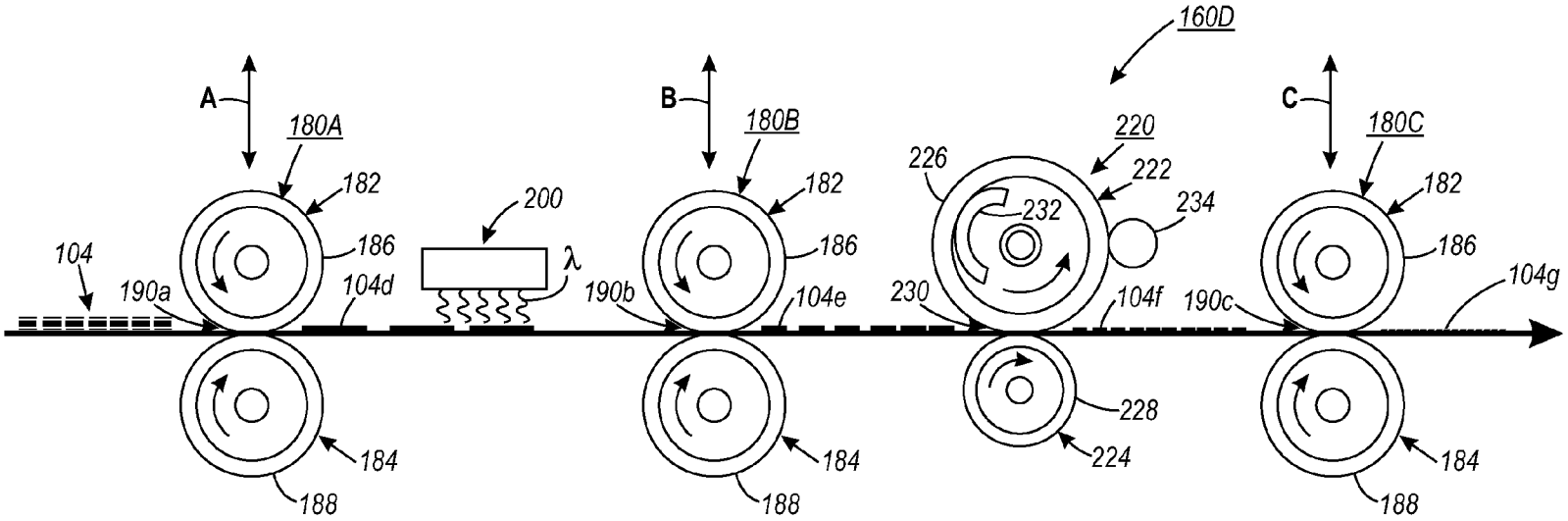
FIG. 6 depicts another exemplary embodiment of a fixing system.

Other embodiments of the fixing systems can include two or more conditioning devices. FIG. 6 depicts a fixing system 160D according to another exemplary embodiment that includes three conditioning devices. As shown, the fixing system 160D includes a pre-heating device 200, a fixing device 220, a conditioning device 180A positioned upstream of the pre-heating device 200, a conditioning device 180B positioned between the pre-heating device 200 and the fixing device 220, and a conditioning device 180C positioned downstream of the fixing device 220. In this embodiment, the pre-heating device 200 and the (thermal) fixing device 220 can have the same or a similar construction, or a different construction, as the pre-heating device 200 and the fixing device 220, and each of the ("non-thermal") conditioning devices 180A, 180B and 180C can have the same or a similar construction, or a different construction, as the conditioning device 180, of the fixing systems 160A, 160B and 160C shown in FIGS. 3, 4 and 5, as described herein.

In the fixing system 160D, the first roll 182 of each of the conditioning devices 180A, 180B and 180C is selectively movable toward or away from the second roll 184, as indicated by arrows A, B and C, respectively. The first roll 182 of any one, any two or all three of the conditioning devices 180A, 180B and 180C can selectively be moved toward, and into contact with, the second roll 184 to form any one, any two or all three of the nips 190*a*, 190*b* and 190*c*, respectively.

Accordingly, in embodiments of the fixing systems, such as the fixing system 160C, the non-thermal conditioning device can provide toner image post-conditioning after the thermal fixing device to improve the gloss uniformity and/or to alter the average gloss level.

In the fixing systems 160A, 160B, 160C and 160D, the use of one or more non-thermal conditioning devices for conditioning of toner extends further advantages of the applied pressure and temperature conditions of the pre-heating device and thermal fixing device to produce a high image quality output. The initial toner pre-heating (softening) step is further exploited by pressure, in addition to heat. Low-temperature, moderate pressure conditions provided by the fixing device can be further extended to achieve additional viscoelastic flow of toner into the substrate for improved coalescence.

In embodiments of the printing apparatus 100, the use of pre-heating of the substrate 102 and marking material 104 combined with relatively-lower temperatures used at the fixing nip 230 can facilitate the use of low-melting and ultra-low-melting toner materials. Exemplary ultra-low-melting toners comprise a crystalline polymer material, such as crystalline polyester material, and an amorphous polymer material, such as amorphous polyester material, with the amorphous material having a glass transition temperature ($T_g$) separate from the melting temperature ($T_m$) of the crystalline material. In these toners, the crystalline polymer material imparts a low melting temperature to the toner.

Figure 7:
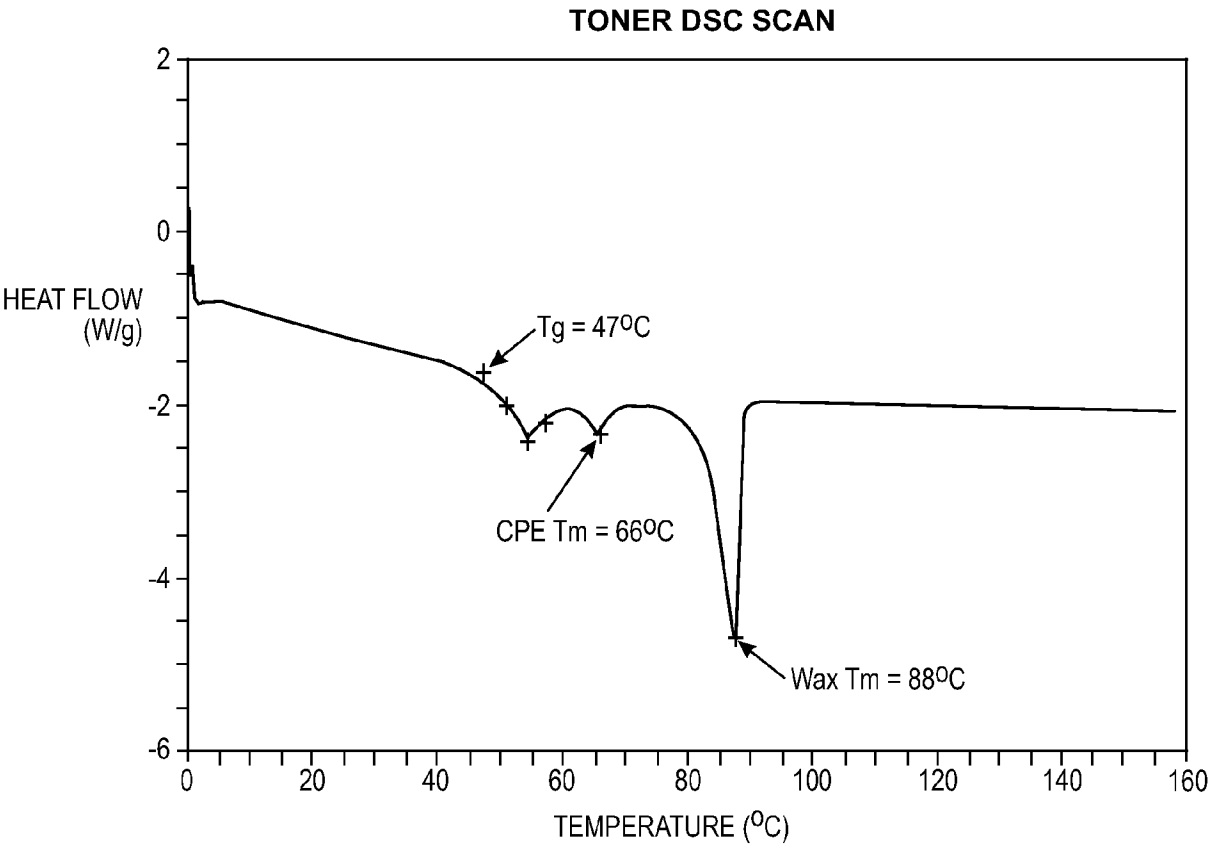
FIG. 7 shows a differential scanning calorimetry (DSC) scan for an exemplary toner material.

FIG. 7 shows a differential scanning calorimetry (DSC) scan of heat flow versus temperature for an exemplary toner material that can be used in embodiments of the printing apparatus 100. The toner contains a crystalline polyester resin, an amorphous polyester resin, and a wax. As shown, the amorphous resin has a glass transition onset temperature, $T_g$, of 47° C., the crystalline polyester resin has a melting temperature, CPE $T_m$, of 66° C., and the wax has a melting temperature, Wax $T_m$, of 88° C.

Exemplary toners having alterable melting temperature characteristics that may be used in the fixing device are disclosed in U.S. Pat. Nos. 7,402,371; 7,494,757 and 7,547,499, each of which is incorporated herein by reference in its entirety.

Furthermore, at low operating set-points that can be used in embodiments of the fixing systems, low substrate temperatures can avoid substrate distortion problems that can occur at elevated process temperatures. This feature can extend the substrate application space achieved with xerographic printing systems, for example. For example, polymeric film materials used in packaging applications may be used as the substrate in the fixing systems. The use of low operating temperatures can also reduce or avoid water evaporation and reabsorption by paper and, consequently, can minimize or eliminate this potential source for paper distortion.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fixing system for fixing marking material to a substrate, comprising:

a non-contact pre-heating device for pre-heating a substrate and marking material disposed on a surface of the substrate;

a heated fixing device disposed downstream from the non-contact pre-heating device, the heated fixing device comprising:

a pair of fixing members which oppose each other and form a fixing nip; and a thermal energy source for heating at least one of the pair of fixing members;

the pair of fixing members applying pressure and heat to the pre-heated substrate and the pre-heated marking material disposed on the surface of the substrate at the fixing nip to fix the marking material to the substrate; and at least one non-heated conditioning device positioned between the non-contact pre-heating device and the heated fixing device comprising a pair of non-heated conditioning members which oppose each other to apply pressure to level the marking material disposed on the surface of the substrate, wherein, when received by the at least one non-heated conditioning device, the substrate and the marking material disposed on the substrate are at a temperature condition that satisfies a relationship: Tamb<Tint<Tm, where Tamb is ambient temperature, Tint is a temperature at an interface between the marking material and the surface of the substrate on which the marking material is disposed, and Tm is a melting temperature of the marking material, and the temperature Tint is increased to at least Tm when the substrate and the marking material disposed on the substrate are passed through the fixing nip.

2. The fixing system of claim 1, the non-contact pre-heating device heating the substrate and the marking material disposed on the surface of the substrate by heating.

3. The fixing system of claim 1, wherein:

the pair of fixing members comprise a first roll including a first surface and a second roll including a second surface, the second surface forming the fixing nip with respect to the first surface; and the pair of non-heated conditioning members comprise a third roll including a third surface and a fourth roll including a fourth surface, the third surface and the fourth surface cooperating to apply the pressure to level the marking material disposed on the surface of the substrate.

4. The fixing system of claim 3, wherein:

the thermal energy source heats at least one of the first surface and the second surface to a temperature from about 50° C. to about 120° C.;

the first roll and second roll cooperate to apply a pressure of about 300 psi to about 1500 psi at the fixing nip; and the third roll and fourth roll cooperate to apply a pressure of about 100 psi to about 5000 psi to level the marking material disposed on the surface of the substrate.

5. The fixing system of claim 3, wherein:

the first surface comprises anodized aluminum impregnated with a material having toner release properties; and the second surface comprises polyurethane.

6. The fixing system of claim 3, wherein each of the third surface and the fourth surface comprises a metal or ceramic material impregnated with polytetrafluoroethylene.

7. A printing apparatus, comprising:

the fixing system according to claim 1; and a marking device for applying the marking material to the surface of the substrate.

8. The fixing system of claim 1, further comprising:

at least one additional non-heated conditioning device comprising a pair of respective additional non-heated conditioning members respectively opposing each other and configured to apply pressure to level the marking material disposed on the surface of the substrate, the at least one additional non-heated conditioning device being a separate conditioning device from the at least one non-heated conditioning device, wherein the at least one additional non-heated conditioning device positioned at one or more of upstream from the non-contact pre-heating device and downstream from the heated fixing device.

9. The fixing system of claim 8, wherein:

the pair of non-heated conditioning members include opposed rolls which are relatively movable toward each other and away from each other to adjust an applied pressure for leveling the marking material disposed on the surface of the substrate; and the pair of respective additional non-heated conditioning members include opposed rolls which are relatively movable toward each other and away from each other to adjust a second applied pressure for leveling the marking material disposed on the surface of the substrate.

10. A printing apparatus, comprising:

the fixing system according to claim 8; and a marking device for applying the marking material to the surface of the substrate, wherein the marking device comprises at least one marking station containing a supply of the marking material for applying to the surface of the substrate.

11. A method of fixing marking material to a surface of a substrate, comprising:

applying marking material to a surface of a substrate with a marking device;

pre-heating the substrate and the marking material disposed on the surface of the substrate using a non-contact pre-heating device;

feeding the pre-heated substrate and the pre-heated marking material disposed on the surface of the substrate to a fixing nip of a heated fixing device disposed downstream from the non-contact pre-heating device, the fixing nip being formed by a pair of opposed fixing members, at least one of the pair of opposed fixing members being heated by a heat source;

applying heat and pressure to the pre-heated substrate and the pre-heated marking material disposed on the surface of the substrate at the fixing nip to fix the marking material on the substrate;

feeding the substrate and the marking material disposed on the surface of the substrate to at least one non-heated conditioning device positioned between the non-contact pre-heating device and the heated fixing device, the at least one non-heated conditioning device being comprised of a pair of opposed first non-heated conditioning members that apply pressure to level the marking material disposed on the surface of the substrate; and applying pressure to level the marking material disposed on the surface of the substrate with the at least one non-heated conditioning device, wherein, when received by the at least one non-heated conditioning device, the substrate and the marking material disposed on the surface of the substrate are at a temperature condition that satisfies a relationship: Tamb<Tint<Tm, where Tamb is ambient temperature, Tint is a temperature at an interface between the marking material and the surface of the substrate on which the marking material is disposed, and Tm is a melting temperature of the marking material, and the temperature Tint is increased to at least Tm when the substrate and the marking material disposed on the surface of the substrate are passed through the fixing nip.

12. The method of claim 11, further comprising:

feeding the substrate and the marking material disposed on the substrate to at least one additional non-heated conditioning device, the at least one additional non-heated conditioning device comprising a pair of respective additional non-heated opposed conditioning members, the at least one additional non-heated conditioning device being a separate conditioning device from the at least one non-heated conditioning device; and applying pressure to separately level the marking material disposed on the surface of the substrate at the at least one additional non-heated conditioning device.

13. The method of claim 11, the pre-heating the substrate and the marking material disposed on the surface of the substrate comprising applying radiant heating, the radiant heating pre-heating the substrate and the marking material disposed on the surface of the substrate.

* * * * *